US012606360B2

(12) United States Patent
Pittevils et al.

(10) Patent No.: US 12,606,360 B2
(45) Date of Patent: Apr. 21, 2026

(54) AEROSOL CONTAINER CONTAINING FOOD PRODUCT

(71) Applicant: FrieslandCampina Nederland B.V., Amersfoort (NL)

(72) Inventors: Piero Leopold M. Pittevils, Schoonderbuken (BE); Annick Albertine Alfons Dumon, Zoutleeuw (BE); Kaustubh Ashok Goswami, Bennekom (NL)

(73) Assignee: Friesland Campina Nederland B.V., Amersfoort (NL)

( * ) Notice: Subject to any disclaimer, the term of this patent is extended or adjusted under 35 U.S.C. 154(b) by 168 days.

(21) Appl. No.: 18/517,865

(22) Filed: Nov. 22, 2023

(65) Prior Publication Data

US 2024/0083664 A1 Mar. 14, 2024

(51) Int. Cl.
*B65D 83/20* (2025.01)
*B65D 83/141* (2025.01)
(Continued)

(52) U.S. Cl.
CPC ..... *B65D 83/206* (2013.01); *B65D 83/141* (2025.01); *B65D 83/224* (2013.01)

(58) Field of Classification Search
CPC .. B65D 83/206; B65D 83/141; B65D 83/224; B65D 83/40; B65D 83/42; B65D 83/55
See application file for complete search history.

(56) References Cited

U.S. PATENT DOCUMENTS 3,185,350 A * 5/1965 Abplanalp ..... B65D 83/22 222/402.11
4,243,161 A * 1/1981 Ewald ..... B65D 83/24 251/350

(Continued)

FOREIGN PATENT DOCUMENTS

CA 718745 A 9/1965
JP 2000-005657 A 1/2000

(Continued)

OTHER PUBLICATIONS

International Search Report received in PCT Application No. NL2022/050285 dated Sep. 20, 2022.

*Primary Examiner* — Vishal Pancholi
(74) *Attorney, Agent, or Firm* — Foley & Lardner LLP

(57) ABSTRACT

An aerosol container containing food product, wherein the container is provided with a manually operable discharge device (3), wherein the discharge device (3) includes a coupling structure (10) for connecting the discharge device (3) to the aerosol container (1), wherein the discharge device (3) includes a manually operable actuating member (7) that is positioned in a first position with respect to the coupling structure (10) before initial use, wherein the discharge device (3) includes blocking means (10*b*) for preventing valve actuating movement of the actuating member (7) when the actuating member (7) is in its first position, wherein the actuating member (7) is movable from the first position to a second position with respect to the coupling structure (10), the second position providing an operating condition of the actuating member (7) for actuating a discharge valve (4) of the container (1) to discharge food product (F), in particular an operating condition wherein the actuating member is manually (Continued)

movable with respect to the container (1) for actuating a valve stem (4*a*) of the valve, wherein the discharge device includes locking means (7*d*) for locking the actuating member (7) in its operating condition, the locking means (7*d*) in particular preventing moving the actuating member back from the second position to the first position.

19 Claims, 11 Drawing Sheets

(51) Int. Cl.
*B65D 83/206* (2025.01)
*B65D 83/224* (2025.01)

(56) References Cited

U.S. PATENT DOCUMENTS

| | | | | |
|---|---|---|---|---|
| 4,428,509 | A | 1/1984 | Emerson et al. | |
| 2005/0121474 | A1 | 6/2005 | Lasserre et al. | |
| 2010/0062096 | A1* | 3/2010 | Clauwaert ..... | B65D 83/145<br>222/402.1 |

FOREIGN PATENT DOCUMENTS

| | | | |
|---|---|---|---|
| JP | 2006-240735 | A | 9/2006 |
| JP | 5311645 | B2 | 3/2009 |
| WO | WO-2010/140881 | | 12/2010 |

* cited by examiner

AEROSOL CONTAINER CONTAINING FOOD PRODUCT

This application is a continuation of International Patent Application No. PCT/NL2022/050285 filed May 25, 2022, which application claims the benefit of European Patent Application No. 21176213.3 filed on May 27, 2021, both of which are incorporated herein by reference in their entireties.

The invention relates to an aerosol container containing food product, wherein the container is provided with a manually operable discharge device, wherein the discharge device includes a coupling structure for connecting the discharge device to the aerosol container.

WO2010/140881 discloses an assembly for dispensing a product, including a rigid aerosol container, having at least one reservoir containing a propellant and a food product, and an operable discharge valve for discharging the food product. The device has manually operable discharge means, configured to cooperate with the discharge valve to discharge the food product.

Particularly, during operation of the aerosol container, in case of operating the discharge means, cream is ejected via a distal dispensing head and undergoes a so called 'overrun', such that a 'spray cream' which resembles common whipped cream, is obtained. In the known device, the container comprises valve means and a small discharge nozzle. During activation, the nozzle sprays the cream into a food product receiving space that is defined by the dispensing head, upon which the cream preferably expands to a desired degree and is agitated vigorously due to expanding propellant.

The known device includes a coupling member that can provide a reliable connection between the discharge means and the aerosol container. A removable covering of the known coupling member can protect the external part of the aerosol valve before use, for example during transport, storage and delivery of the container. Thus, it can prevent that the valve is accidentally actuated. Also, the covering can insure maintenance of hygienic conditions, particularly by preventing people to touch the external valve part. Besides, the removable covering can provide tamper evidence. Also, according to an embodiment, a breakable or tearable connection can be implemented, to releasably hold an edge of an additional cap to provide a tamper evidence means. Such a breakable of tearable connection can be manufactured by a thermal process, for example by applying heat to locally melt material, by ultrasonic welding, or differently.

Tamper evidence is important for food product distribution in view of consumer safety. The tamper evidence embodiments of the known assembly work well but have some disadvantages. The tearing or breaking of a tamper evidence section of the assembly can require significant (manual) force.

JP5311645B2 concerns improved manufacturing of an aerosol container.

JP2006-240735A discloses a continuous action mode aerosol container.

JP 2000-005657A provides a spout of a liquid jetting pump, wherein part of a trigger can be folded back to prevent trigger operation.

U.S. Pat. No. 4,428,509A concerns a dispensing device for continuous aerosol dispensing.

CA718745A discloses an aerosol dispensing structure, providing a cooperating protective hood for a) locking the valve actuator against inadvertent operation (during shipment or shelf life), b) permit the actuator to be retained in position for continuous discharge and c) permit the valve for intermittent operation.

An object of the present invention is to improve the aerosol container. Particularly, the invention aims to provide a semi-professional, or even a professional, appearance of the container, wherein utilization of the container can be carried out in a straightforward manner, without leading to a considerable rise in the manufacturing costs. Moreover, it is desired that high hygiene standards are maintained, or even improved.

According to an aspect of the invention, this is achieved by an aerosol container as defined in claim 1.

In particular, there is provided an aerosol container containing food product, wherein the container is provided with a manually operable discharge device, wherein the discharge device includes a coupling structure for connecting the discharge device to the aerosol container, wherein the discharge device includes a manually operable actuating member that is positioned in a first position with respect to the coupling structure before initial use, wherein the discharge device includes blocking means for preventing valve actuating movement of the actuating member when the actuating member is in its first position, wherein the actuating member is movable from the first position to a second position with respect to the coupling structure, the second position providing an operating condition of the actuating member for actuating a discharge valve of the container to discharge food product, in particular an operating condition wherein the actuating member (at least part thereof) is manually movable with respect to the container (to a third position) for actuating a valve stem of the valve, wherein the discharge device includes locking means for locking the actuating member in its operating condition, the locking means in particular preventing moving the (entire) actuating member back from the second position to the first position.

In this way, an improved tamper-evident food product aerosol container can be achieved. For example, before a first, initial use (e.g., during storage or transport of the container), the actuating member is in its first position (i.e., an idle, passive, position). In that position, the actuating member cannot be moved (e.g., pressed downwardly) in a direction to operate the valve of the container, so that undesired accidental discharge of food product can be prevented.

During initial use, when a first discharge of food product is desired, a user can move (e.g., turn) the actuating member to its second position, which is the operating (i.e., active, activated) condition, so that the actuating member can be operated by the user in order to move the aerosol valve to an opened valve position, resulting in product discharge. Operating the actuating member can e.g., include manually moving the entire actuating member, or part thereof, with respect to the coupling member. The locking means of the discharge device can ensure that the actuating member remains in its second position (to be operated by a user, to reach e.g., a third—operated—valve opening position), preventing return of the actuating member to the first (idle) position. Herein, it is preferred that the locking means of the discharge device can apply a mechanical locking force to the actuating member to lock that member in its second position, wherein the locking force cannot be overcome without damaging (e.g., plastically deforming or breaking) components of the discharge device. Thus, the position actuating member itself can provide a clear, strong tamper-evident indicator (the actuating member being in its first position meaning that the aerosol container has not been used yet for discharging food product).

Also, the present innovative configuration can provide a semi-professional, or even a professional, appearance of the container, wherein utilization of the container can be carried out in a straightforward manner, without leading to a considerable rise in the manufacturing costs. Moreover, high hygiene standards can be maintained and even improved by the present aerosol container.

It should be observed that the actuating member can optionally be held in its first position via a tearable or breakable connection, but that is not required. To the contrary, it is preferred that no tearable connection and no breakable connection is present to hold the actuating member in its first position. In a preferred aspect, a releasable clamping means, releasable clicking means and/or a removable cap of the discharge device can releasably hold the actuating member in its first position before first use, such that a user can move the actuating member to its second position with relative ease (by overcoming a respective clamping or clicking force and/or removing the optional cap, thereby releasing the actuating member).

According to a preferred embodiment, the locking means can include a hook member, being e.g., part of the actuating member or the coupling structure, configured to enter a locking state to lock the actuating member in its operating condition when the actuating member enters its second position from its first position. In this way, a relatively firm locking of the second position of the actuating member can be achieved. According to a further embodiment the locking means include a hook member locking structure for receiving and retaining the hook member when the actuating member is in its operating condition, wherein the hook member and locking structure are preferably configured to cooperate to allow valve actuating movement of the actuating member when the actuating member is in its operating condition. For example, the hook member can snap into a locking position with respect to the locking structure when the actuating member is moved from the first to second position, wherein the locking structure still provides a certain freedom of movement or path that allows hook member movement in the same direction as actuating member movement during valve actuation by the actuating member. In this way, actuator member movement in order to open the container valve is not blocked by the hook member and respective locking structure.

Also, an aspect of the invention provides a manually operable discharge device, evidently being configured to be part of an aerosol container according to the invention.

Further, an aspect of the invention provides use of an aerosol container according to the invention, including the steps:

- providing the aerosol container having the actuating member is in its first position with respect to the coupling structure;
- moving the actuating member from the first position to the second position with respect to the coupling structure, such that the actuating member becomes locked in its operating condition; and
- manually actuating the actuating member (e.g., by moving at least part of the actuating member with respect to the coupling structure) to discharge food product from the container.

In this way above-mentioned advantages can be achieved.

In the following, the invention will be explained further using exemplary embodiments and drawings. The drawings are schematic. In the drawings, similar or corresponding elements have been provided with similar or corresponding reference signs.

FIG. 19C is a detail Y2 of FIG. 19A; and

Figure 1:
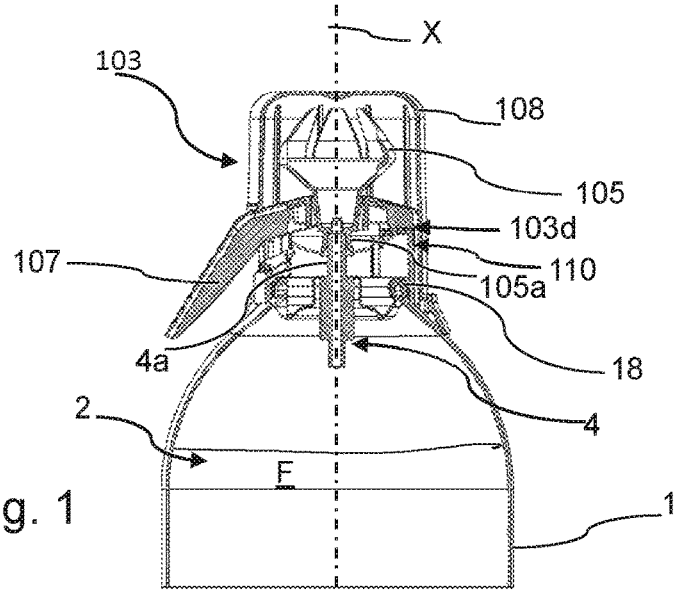
FIG. 1 depicts a longitudinal cross-section of part of a prior-art aerosol container.

FIG. 1 depicts an aerosol container 1 (at least an upper part thereof) containing food product F. The container 1 has a reservoir 2 containing a propellant and a food product, and an operable discharge valve 4 or valve means, having a valve stem 4*a* for discharging the food product. In particular, the valve can be located at an upper section of the container.

The present container 1 can be configured to be used upside down, and therefore does not comprise a clip-tube dispensing mechanism. As an example, the container 1 can be provided with operable valve means 4, comprising a downwardly (i.e., towards a container bottom) depressible food product ejection stem 4*a* and spring means to counteract the depressing of the stem 4*a*, such as in a currently marketed spray food product aerosol container, as will be appreciated by the skilled person. For example, depressing of the food product ejection nozzle/stem 4*a* leads to opening of the valve means so that food product and part of the propellant can be ejected towards the dispensing head, to be dispensed thereby. Mentioned spring means can urge the valve to a closed position.

Each container 1 is preferably compact (for example with an overall volume less than 1 l), of a lightweight construction. Also, for example, initially, a packed container 1, comprising the food product, can weigh less than 1 kg, such as about 750 or 250 g. According to an embodiment, the container as such is made of tinplate or aluminum, coated on the inside, and has a substantially cylindrical shape. As follows from the above, the container can also be made of a different material, for example a rigid plastic. Also, the present aerosol container 1 is of a non-refillable type, to be discarded after being used up. The present container 1 is of a relatively inexpensive, durable construction, having few components. Generally, an upper end of the container may include a circumferential flange 18, the circumferential flange being e.g., an integral part of a container wall (herein, it should be noted that the valve structure as such can provide a section of the container wall, or be fixed to the container wall, closing off the container at its upper section).

The container 1 can comprise at least one reservoir 2 containing the food product, the food product being safe for consumption, and a suitable propellant. As a non-limiting example, the aerosol container can be packed with food product and propellant, the initial pressure in the container being for example in the range of 7-18 atmospheres, depending on the amount of packed food product, as will be appreciated by the skilled person. The propellant can consist of one or more gasses acceptable from the viewpoint of food technology, for example a gas which substantially dissolves in the food product, a gas which substantially does not dissolve in the food product and a combination of these gasses. Particularly, the propellant can comprise CO2, nitrogen (N2), laughing gas (N2O) or a combination of these gasses (such as nitrogen and laughing gas). For example, 15-25 w % (weight %) of the propellant can be N2 and the remainder of the propellant (i.e., 85-75 w %) can be N2O.

At least part of the propellant can be packed separately from the food product, for example in the case that the container is provided with separate reservoirs, for example with a movable or flexible partition to provide such separation (such as in European patent application EP 1 061 006 A1). For example, the container can include a first reservoir containing the product, and a second reservoir containing the propellant (separate from the product)

In another embodiment, the propellant and food product are packed together, in the same reservoir, in the aerosol container (for example in case the container is provided with a single reservoir).

In a particular embodiment, the food product comprises cream. In that case, as will be appreciated by the skilled person, a "spray cream" that is obtained from use of the present aerosol container 1 generally differs from conventional whipping cream (obtained from manually or automatically whipping common cream without using a cream propellant) to a high degree. Also, in the case the food product comprises cream as an ingredient, the food product can comprise various other ingredients, for example sugar, emulsifier, stabilizer, aroma. Preferably, the cream has a fat content in the range of about 5%-50%, for example about 40%. Another cream composition can include a fat milk constituent (particularly cream, or common cream) and a non-fat milk constituent (for example skimmed milk), see EP 1 061 006 A1. Generally, a cream food product can comprise at least 80 w % of one or more milk constituents, and preferably at least circa 90 w %.

Referring to the drawings, the container can be provided with a manually operable discharge device 103, wherein the discharge device 103 includes a coupling structure 110 for connecting the discharge device 103 to the aerosol container 1 (e.g., to a said circumferential flange 110). In certain embodiments, the discharge device 103 is firmly, undetachably, attached to the container 1. In other preferred embodiments, the discharge means are detachably connected to the container 1.

For example, the coupling member 110 and the container flange 18 can firmly hold each other using a clamping force, and optionally using adhesive. In a further embodiment, the coupling member 110 can be made of a resilient material, which material provides a clamping force to firmly grip the container after assembly. Optionally, the coupling member 110 and the container 1 are provided with one or more blocking members and/or with a friction enhancing surface, interacting with each other to block turning/rotation of the coupling member 101 with respect to the container 1.

The discharge device 103 can also include a manually operable actuating member 107 and a dispensing head 105. The manually operable discharge device 103 can be configured to cooperate with the discharge valve 4 (in particular the stem 4*a*) of the container to discharge the food product, via the dispensing head 105. Preferably, the dispensing head 105 and actuating member 107 are made in one-piece, for example via a plastic molding process (e.g., injection molding or differently).

Also, the discharge device 103 can include an optional cap 108, e.g., covering the dispensing head 105 before use.

The manually operable discharge means (i.e., discharge mechanism) can include a laterally extending lever 107 as actuating member, the lever being is pivotally connected to a mounting member 103*a*, via a pivot axis 103*d* that is located at or near a front side of a mounting member 103*a* of the device 103. The lever 107 provides an actuating member, configured to be manually pressed downwardly (towards the container) for operating the discharge valve 4, via the respective valve stem 4*a*. In particular, FIG. 1 shows the lever 107 in an initial idle position. From this position, the lever 7 can be pressed towards the mounting member 103*a*, to a second position (such that the lever 107 pivots with respect to pivot axis 103*d*), to operate the container valve 4 (i.e., to axially move valve stem 4*a* from a valve closing position to a valve opening Besides, the discharge means 103 can comprise a distal product dispensing head 105, configured to directly connect to a distal part of the stem 4*a* of the container valve 4 after mounting, such, that product can flow from the valve into the dispensing head 105. For example, after assembly, the valve stem 4*a*, which part protrudes from the container 1, can reach into a central valve receiving neck section 105*a* of the dispensing head, the neck section 105*a* including one or more passages for passing product, received by the neck section 105*a* from the valve, to a food product receiving space that is defined within the dispensing head 105.

Figure 2A:
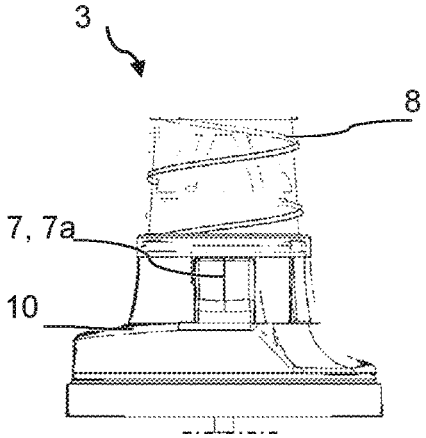
FIG. 2A is a side view of a non-limiting example of part of an aerosol container according to the present invention, with an optional cap, wherein the actuating member is in its first position.
Figure 2B:
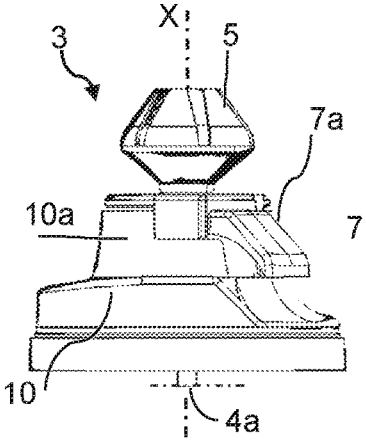
FIG. 2B is similar to FIG. 2A, showing the example without the optional cap, wherein the actuating member is locked in its second position.
Figure 2C:
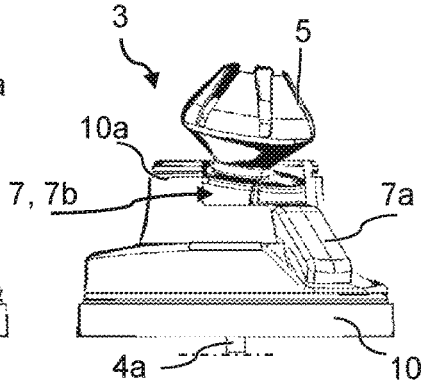
FIG. 2C is similar to FIG. 2B, wherein the actuating member is operating the valve of the aerosol container.

FIGS. 2A, 2B, 2C show part of an improved aerosol container 1, in particular a container 1 having an improved discharge device 3 that can provide improved user interaction and tamper-indication. Generally, a difference between the example of FIGS. 2A, 2B, 2C and the example of FIG. 1 is that the respective actuating member 7 is (initially) movable from a first position to a second position with respect to a respective container coupling structure 10, the first position being an initial position before a first use (shown in FIG. 2A), and the second position being an operating position (shown in FIGS. 2B and 2C) wherein the actuating member 7 can be manually moved to operate the container valve 4 (by moving the member 7 to a third position, shown in FIG. 2C). Moreover, it is preferred that the actuating member 7 cannot be returned back to its first position when it has been moved to its second position. Thus, the actuating member 7 itself can provide a tamper evident feature of the aerosol container 1.

In particular, for example, the aerosol container 1 can be provided with a manually operable discharge device 3, wherein the discharge device 3 includes a coupling structure 10 for connecting the discharge device 3 to the aerosol container 1, wherein the discharge device 3 includes a manually operable actuating member 7 that is positioned in said first position with respect to the coupling structure 10 before initial use.

The actuating member 7 can integrally include or be provided with a dispensing head 5 for dispensing food product F, wherein the dispensing head 5 preferably extends axially opposite the valve stem 4*a* of the container valve 4 to receive food product therefrom (as in the first embodiment, i.e., via a neck section 5*a* of the dispensing head).

The actuating member 7 of the discharge device 3 can be configured in various ways, it can be manufactured by a plastic molding process (e.g., injection molding or differently), be made in one-piece, or be made from several parts joined/fixed together. An actuating member 7 as such is shown in more detail in FIGS. 4-8.

Similarly, the coupling structure 10 of the discharge device 3 can be configured in various ways. For example, it can be a coupling member, manufactured by a plastic molding process (e.g., injection molding or differently). The coupling structure 10 can e.g., be made in one-piece, or be made from several parts joined/fixed together. A coupling structure 10 as such is shown in more detail in FIGS. 9-15.

In particular, the coupling structure 10 shown in FIGS. 9-15 is configured to receive the actuating member 7 shown in FIGS. 4-8, an assembled state being shown in FIGS. 2A, 2B, 2C, 3.

Figure 16:
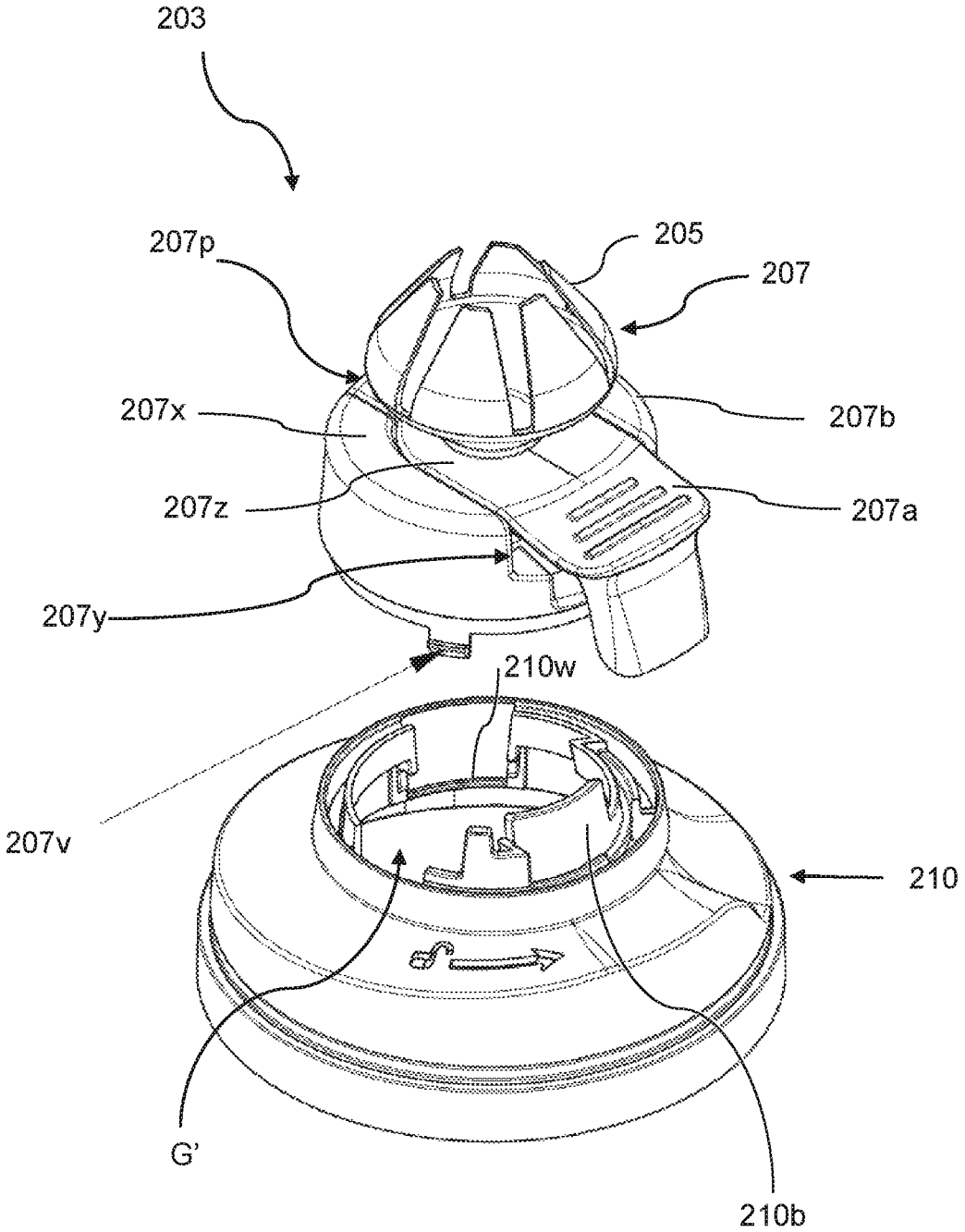
FIG. 16 shows a perspective view of a second non-limiting embodiment of part of an aerosol container according to the present invention, before assembly.
Figure 17:
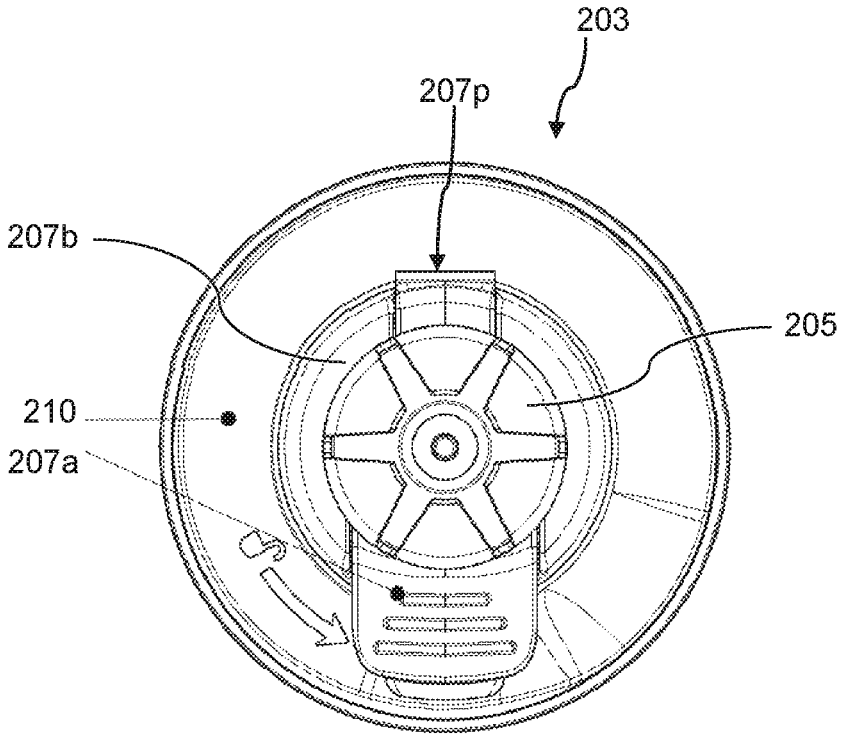
FIG. 17 is a top view of the embodiment of FIG. 16, in assembled condition.
Figure 18:
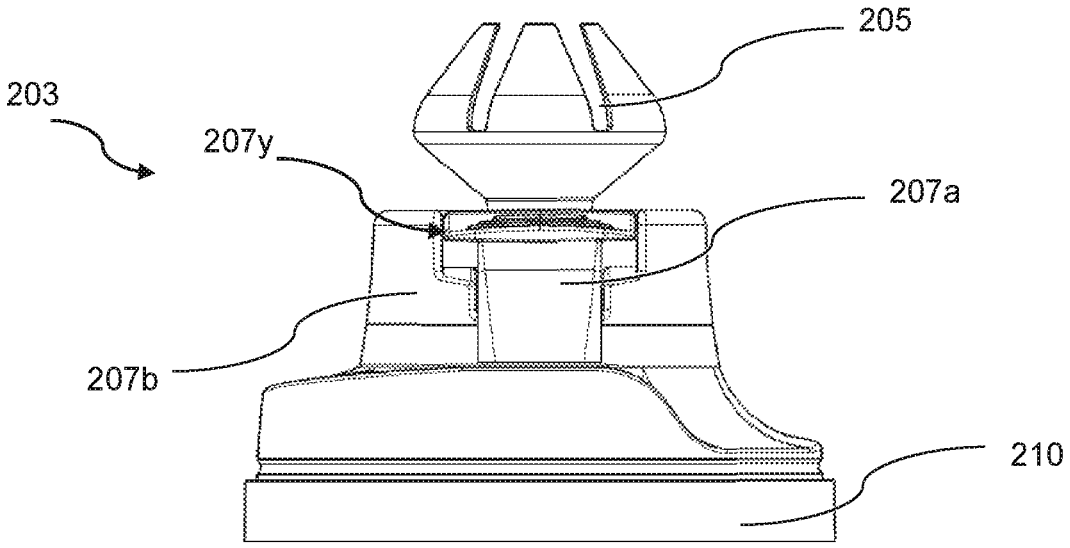
FIG. 18 is a side view of the embodiment of FIGS. 16-17.
Figure 19A:
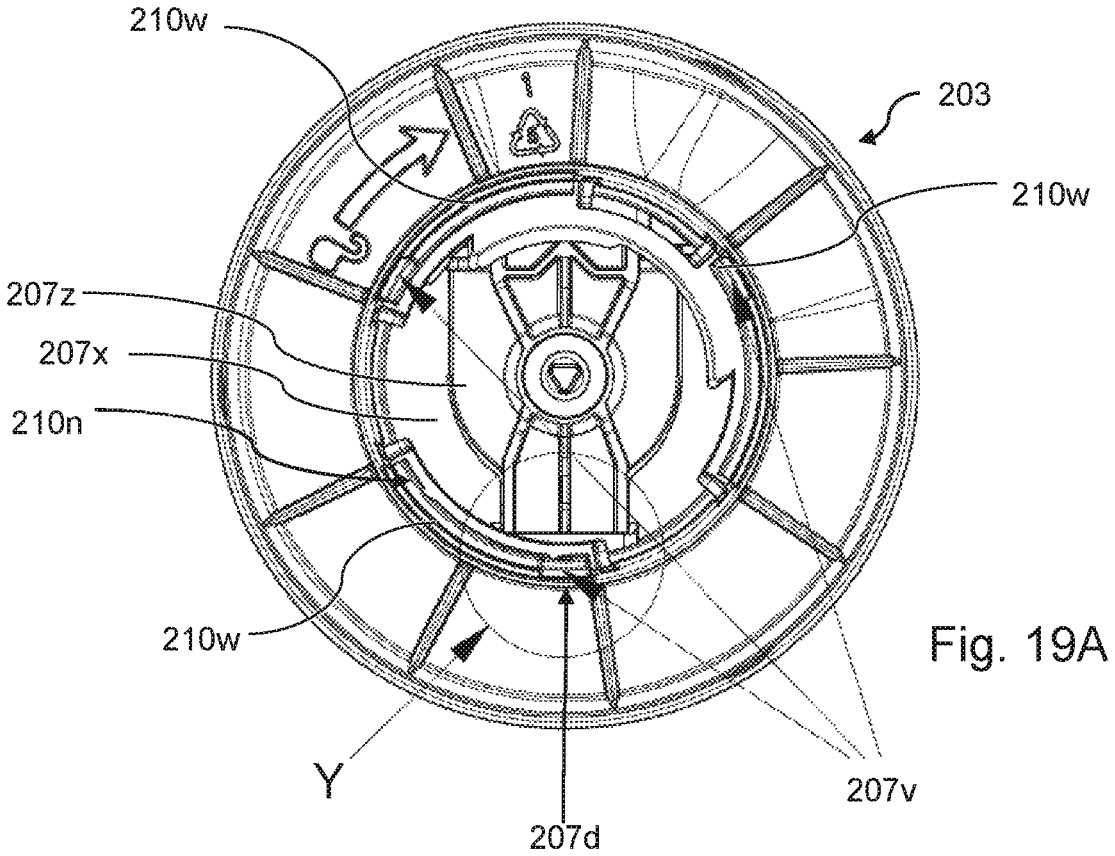
FIG. 19A is a bottom view of the assembly of FIGS. 16-18.
Figure 19B:
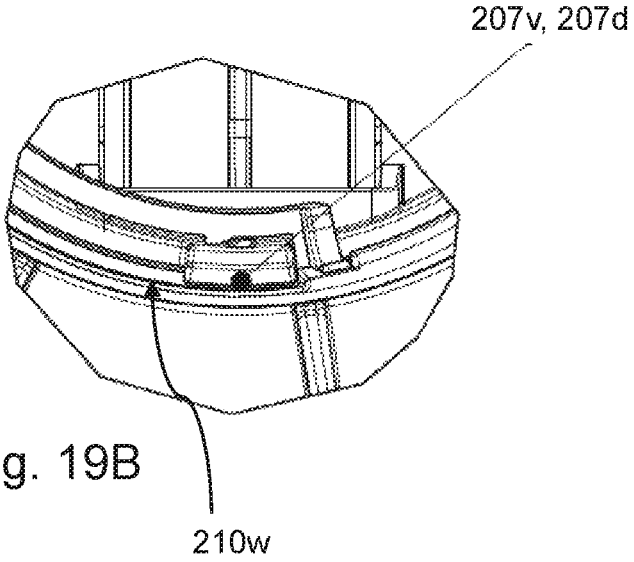
FIG. 19B is a detail Y1 of FIG. 19A.

As follows from the drawings, the actuating member 7 can be movable (e.g. turned) from the first position to a second position with respect to the coupling structure 10, the second position providing an operating condition of the actuating member 7 for actuating a discharge valve 4 of the container 1 to discharge food product F, in particular an operating condition wherein the actuating member is manually movable (e.g. depressible) with respect to the container 1 for actuating a valve stem 4*a* of the valve. In particular, a direction of movement of the actuating member 7 from its first position to its second position is different from a direction of movement during valve actuation (the former movement direction e.g., being a circumferential direction with respect to a container center axis X and the later movement being a pivotal direction with respect to a pivot axis P that is normal with respect to the container center axis X). For example, the actuating member can be entirely or partly manually movable (e.g., depressible) with respect to the container 1 for actuating a valve stem 4*a* of the valve (see also e.g., the examples of FIGS. 16-18 wherein the actuating member as such includes a manually operable pressing member 207*a* that is pivotally connected to a guided section 207*b* of the actuating member).

The discharge device 3 preferably includes blocking means 10*b* for preventing valve actuating movement of the actuating member 7 when the actuating member 7 is in that first position. In particular, the actuating member 7 may already have a cooperating connection with the valve stem 4*a* when the actuating member 7 is in its first position, for example via a neck section 5*a* of the dispensing head that can already be positioned onto the stem 4*a* of the valve. In that case, the actuating member movement blocking means 10*b* can prevent valve operation. For example, the blocking means can include an integral section 10*b* of the coupling structure 10 that can connect/couple the discharge device 3 to the aerosol container 1.

According to an embodiment, a side wall 10*a* of the coupling structure 10 can define (enclose) a guide space G, the actuating member 7 having a guided section 7*b* (e.g., a guided body 7*b*) that is held in the guide space G (i.e., in the coupling structure 10). The actuating member 7 further includes a manually operable pressing member 7*a*, for example a lever or knob, extending laterally from the guided section 7*b* out of the coupling structure 10. The pressing member 7*a* and guided section 7*b* of the actuating member are preferably integrated or fixed to each other, e.g., being made in one-piece, so that the pressing member 7*a* and the guided section 7*b* move jointly (i.e., movement of the pressing member 7*a* leads to movement of the guided section 7*b*).

The actuating member 7 can be rotatably (slidingly) held by the coupling structure 10 such that the actuating member 7 can be rotated from the first position to the second position about a rotation axis X, in particular an axis of rotation X that is or extends in parallel with a center line X of the container 1 and/or in parallel with a valve stem of the discharge valve 4 of the container 1. In particular, the coupling structure 10 and guided section 7*b* of the actuating member 7 can be configured to rotatably connect to each other. One or more radially protruding locking cams 7*t* can be present (e.g., being part of the guided section 7*b* of the actuating member 7) for preventing axial removal of the actuating member from the coupling structure. Further, the coupling structure 10 and guided section 7*b* of the actuating member 7 can be configured to cooperate, to limit sliding/rotational movement of the actuating member 7.

The side wall 10*a* of the coupling structure 10 can be a generally circumferential wall, e.g., an upstanding sleeve or neck portion, and can extend concentrically with respect to a center axis X of the container 1, after mounting. In an embodiment, the side wall 10*a* of the coupling structure includes a circumferential shoulder section 10*d* for connecting the coupling structure to the container 1 (e.g., to a rim 18 thereof).

Figure 3:
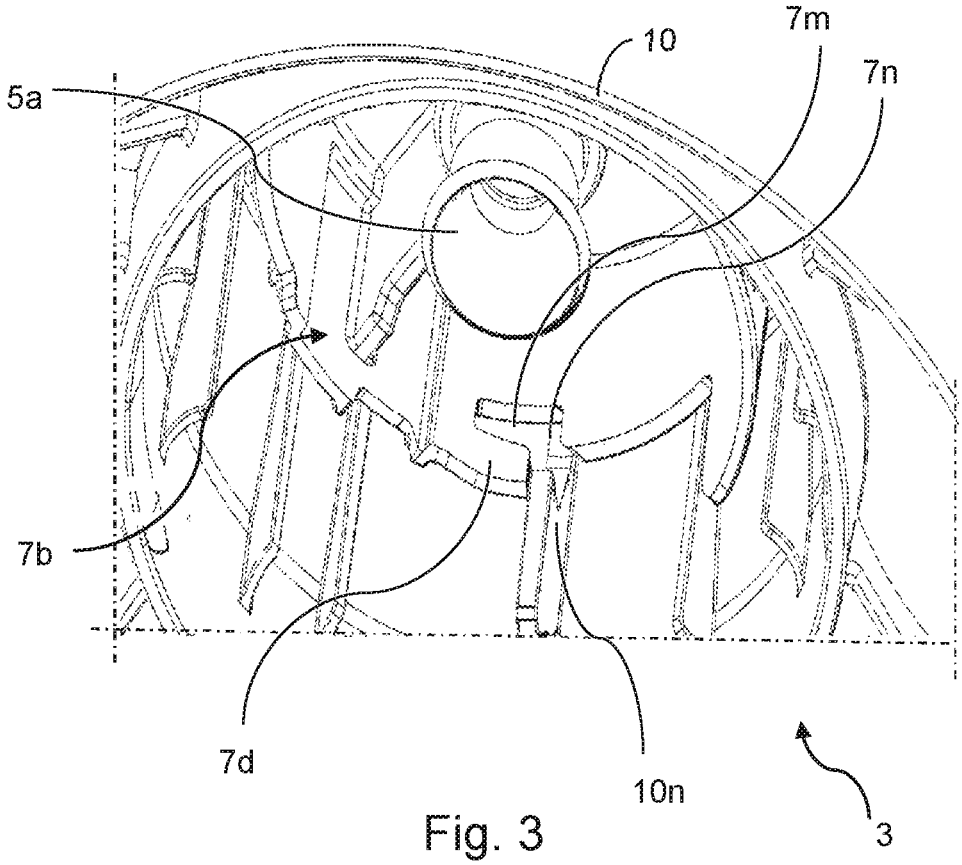
FIG. 3 depicts a perspective bottom view of part of the example of FIGS. 2A-2C.
Figure 4:
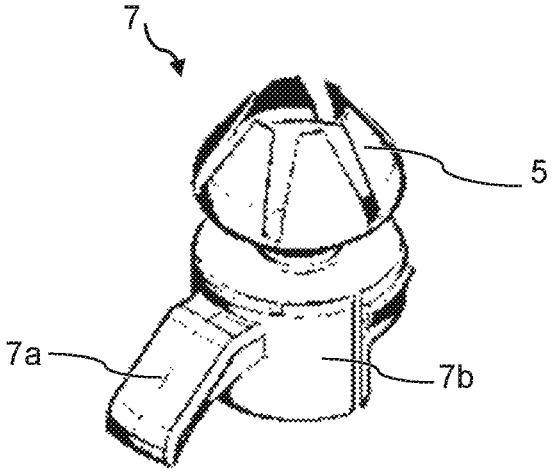
FIG. 4 depicts a perspective top view of part of the example of FIGS. 2A-2C.
Figure 5:
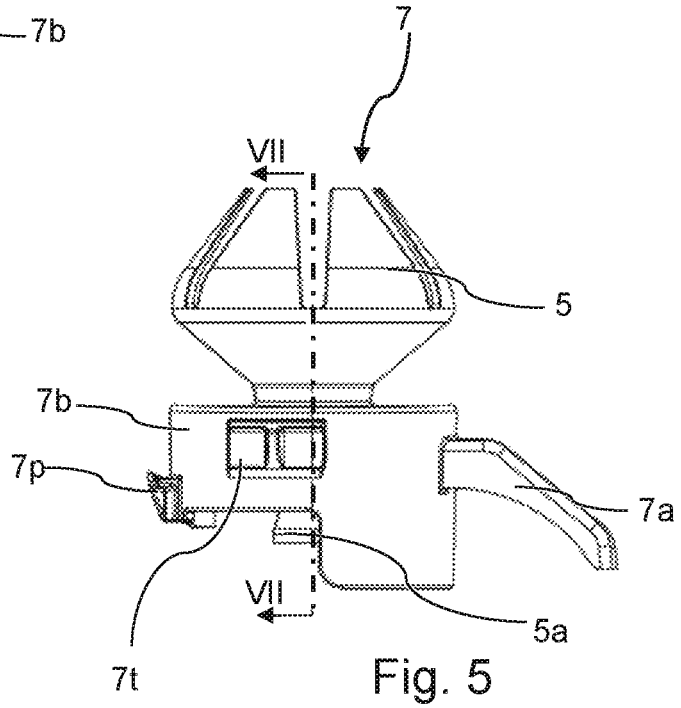
FIG. 5 shows a side view of the device part depicted in FIG. 4.
Figure 6:
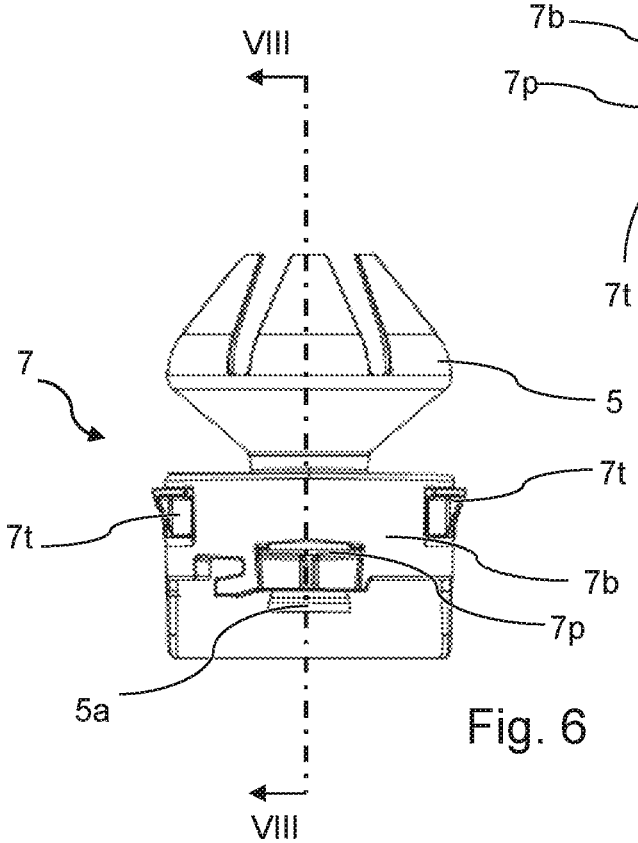
FIG. 6 shows a back view of the device part depicted in FIG. 4.
Figure 7:
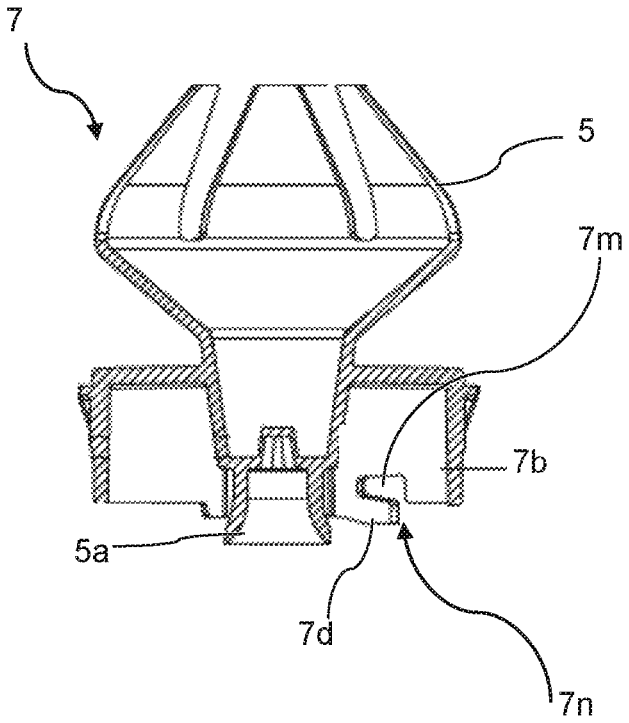
FIG. 7 is a cross-section over line VII-VII of FIG. 5.
Figure 8:
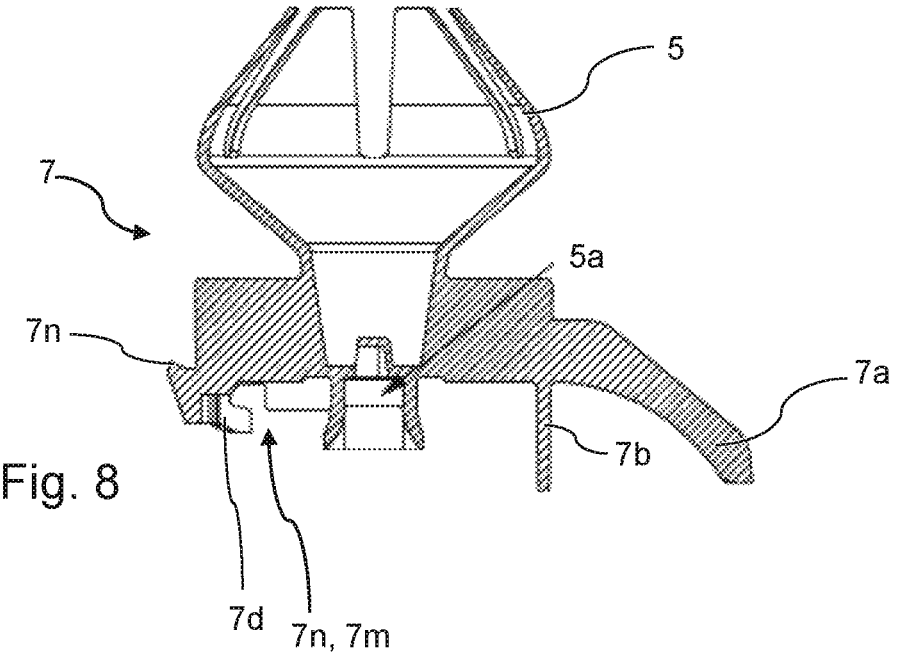
FIG. 8 is a cross-section over line VIII-VIII of FIG. 6.
Figure 9:
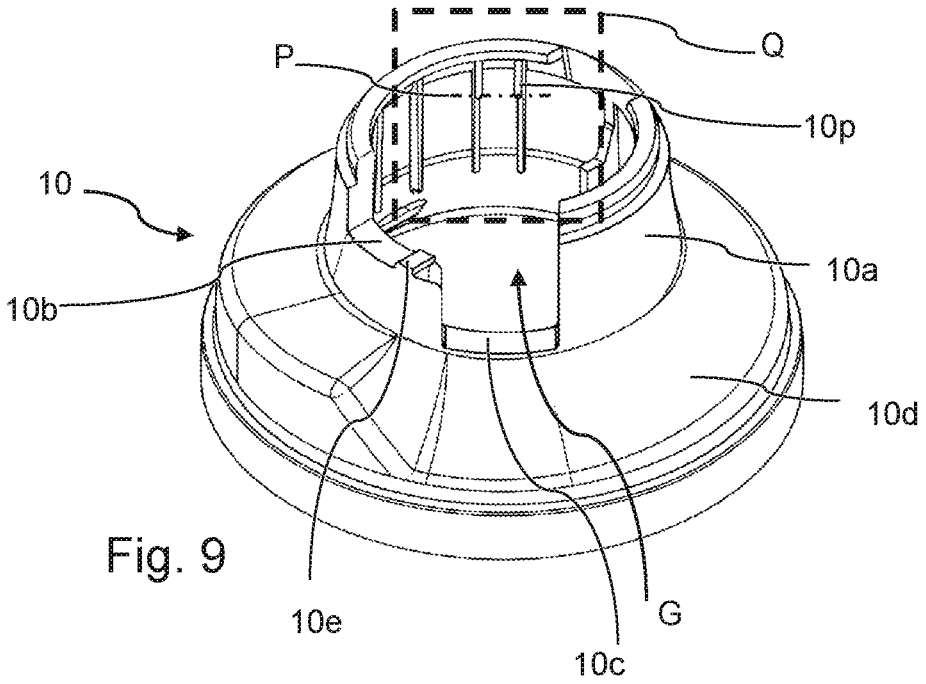
FIG. 9 depicts a perspective top view of another part of the example of FIGS. 2A-2C.
Figure 10:
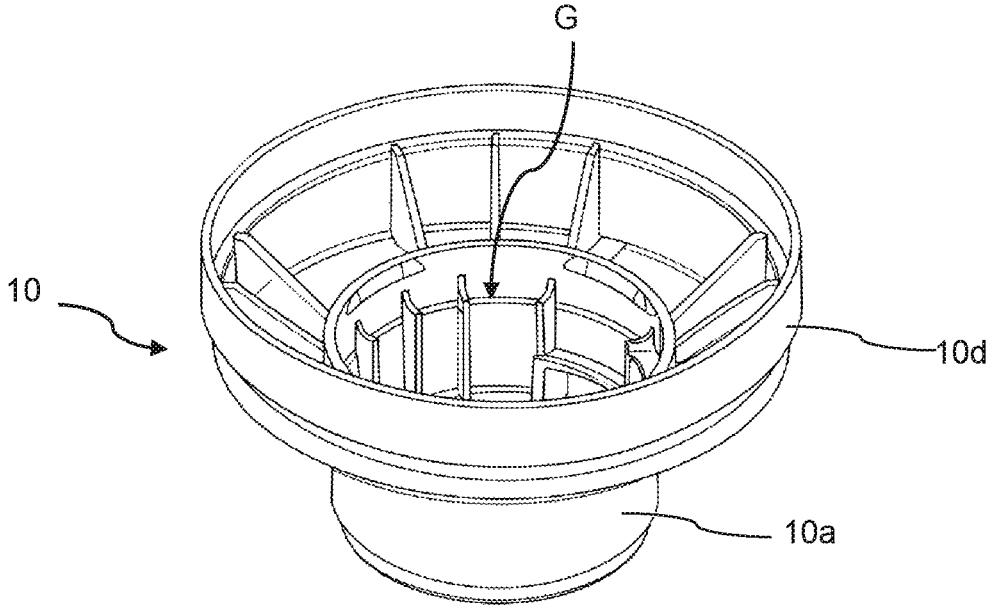
FIG. 10 depicts a perspective bottom view of the other part shown in FIG. 9.
Figure 11:
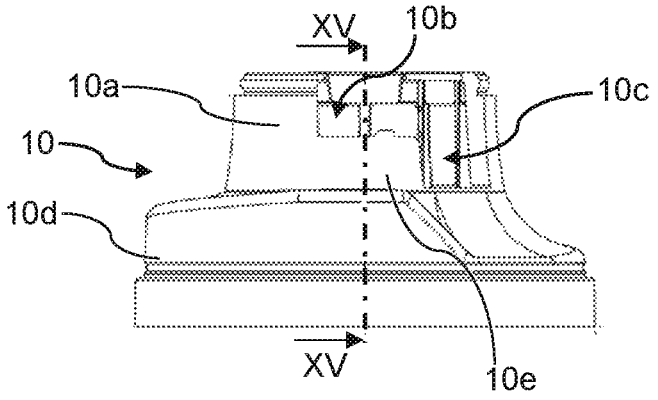
FIG. 11 depicts a front view of the part shown in FIG. 9.
Figure 12:
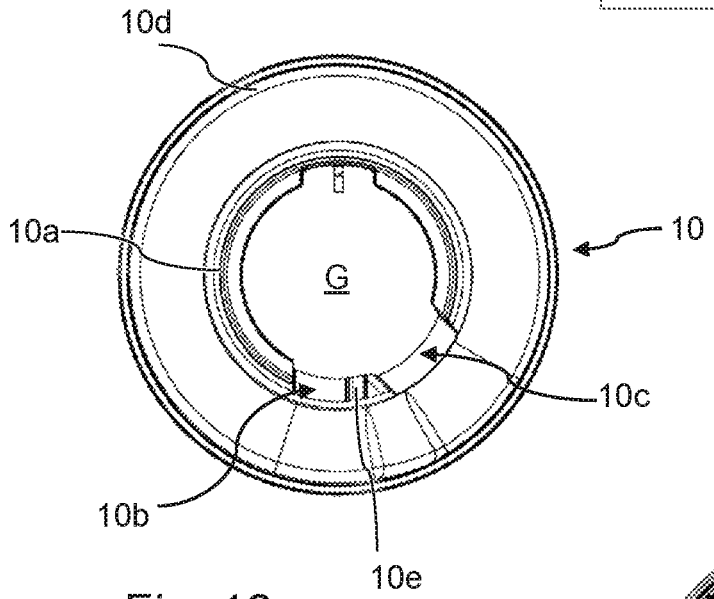
FIG. 12 depicts a top view of the part shown in FIG. 9.
Figure 13:
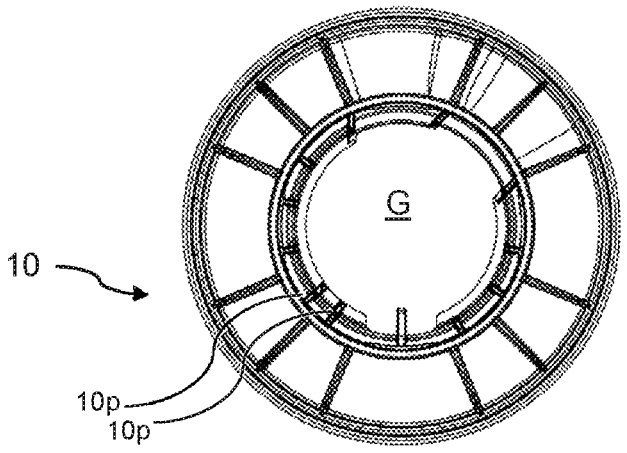
FIG. 13 depicts a bottom view of the part shown in FIG. 9.
Figure 14:
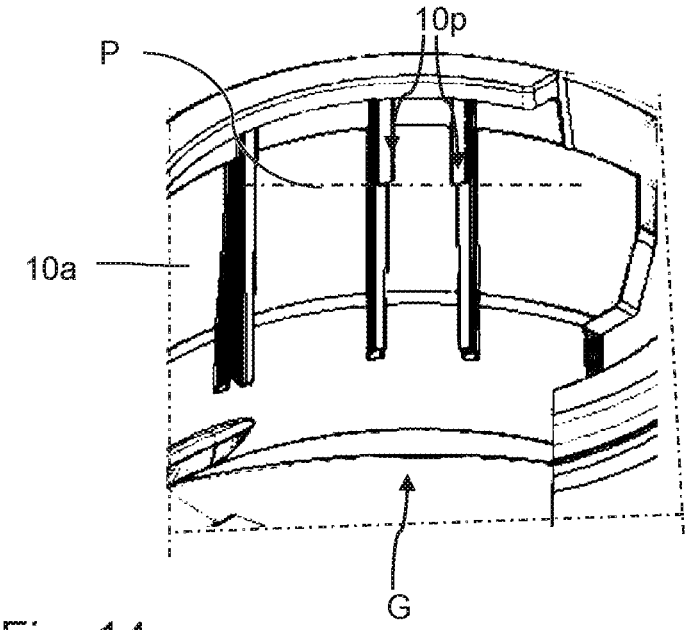
FIG. 14 shows a detail Q of FIG. 9.
Figure 15:
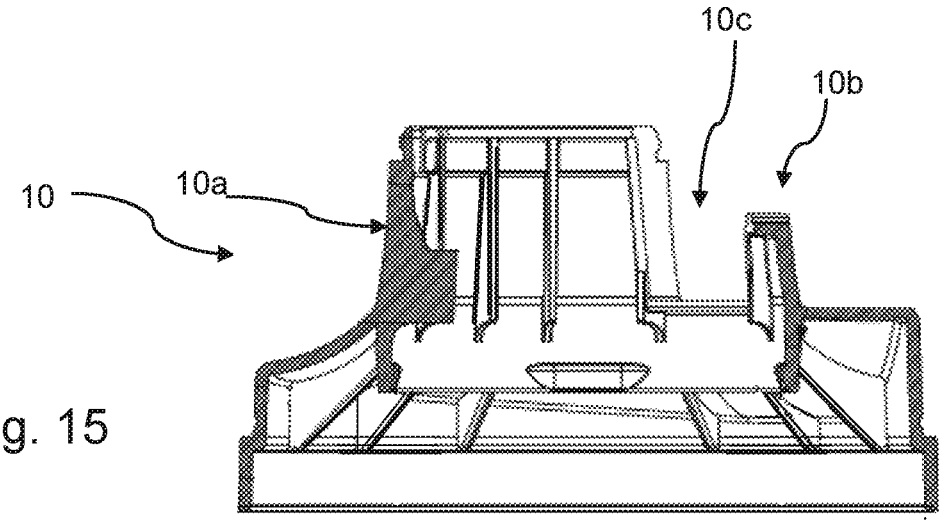
FIG. 15 shows a cross-section over line XV-XV of FIG. 11.

According to an embodiment, the side wall 10*a* of the coupling structure 10 has a first notch section 10*b* for receiving (and supporting) a proximal part of the pressing member 7*a* when the actuating member is in its first position (as in FIG. 2A), and a second notch section 10*c* (e.g. located circumferentially next to the first notch section 10*b*) for receiving (and axially guiding) the same proximal part of the pressing member 7*a* when the actuating member 7 is in its second and third position (as in FIGS. 2B, 2C, 3). In particular, a height of the first notch section 10*b* (measured in axial direction, in parallel with a container center line X) is such that the pressing member 7*a* of the actuating member 7 rests on (is supported by) an upper edge of the side wall 10*a* when the pressing member extends through that notch section 10*b*. In this way, the first notch section 10*b* of the coupling structure 10 prevents actuating movement (i.e., downward movement, towards the container wall) of the actuating member 7. Still, the first notch section 10*b* allows rotational movement of the actuating member 7, towards and into the second notch section 10*c* of the coupling structure wall 10*a*.

In particular, a height of the adjoining second notch section 10*c* (measured in axial direction, in parallel with a container center line X) is such that the pressing member 7*a* of the actuating member 7 can be manually actuated for opening the container valve 4, i.e., to allow the downward movement, towards the container wall, of the actuating member 7 (as follows from FIG. 2C). The height of the second notch section 10*c* can e.g., be at least twice the height of the first notch section 10*b*.

A circumferential width of the first notch section 10*b* is preferably about the same as or slightly larger than a circumferential width of the pressing member 7*a*, so that a stable support and downward movement of the pressing member 7*a* can be achieved when that member is in its first position.

A circumferential width of the second notch section 10*c* is preferably slightly larger than a circumferential width of the pressing member 7*a*, allowing sufficient circumferential space for guiding the pressing member 7*a* between respective operating positions.

The discharge device 3 can includes retaining means for releasably retaining the actuating member 7 in its first position. For example, a removable (optional) cap 8 can be configured to retain the actuating member 7 in place, or onto the edge of the wall 10*a* of the coupling structure, and/or to block rotational movement of the respective laterally extending pressing member 7*a*. Additionally or alternatively, a top edge of the side wall 10*a* of the coupling member 10 can include a relatively small protrusion or cam section 10*e*, at the first notch section 10*b* or between the first and second notch sections 10*b*, 10*c*, for retaining the pressing member 7*a* in the first notch section 10*b* e.g. together with the cap 8, or independently of a cap 8 using a relatively low retaining force. A said relatively small retaining force can be overcome by an operator, by moving the pressing member 7*a* along the cam section 10*e* to the second notch section 10*c*, without damaging respective discharge device components.

The discharge device 3 preferably includes locking means 7*d* for locking the actuating member 7 in its operating condition, the locking means 7*d* in particular preventing moving the (entire) actuating member back from the second position to the first position. In this way, optimum tamper evidence can be achieved. As is mentioned before, it is preferred that the locking means 7*d* of the discharge device 3 can apply a mechanical locking force to the actuating member 7 to lock that member in its second position, wherein the locking force cannot be overcome without damaging (e.g., plastically deforming or breaking) components of the discharge device, such as the actuating member 7 and/or the coupling structure 10.

An embodiment of the locking means 7*d* is shown in more detail in FIG. 3. The locking means can include a hook member 7*d*, for example a hook member 7*d* that can snap into a respective locking position when the actuating member 7 enters its operating position.

According to an example, the hook member 7*d* can being part of the actuating member 7 (see FIG. 3), or alternatively of the coupling structure 10. FIG. 3 shows the hook member 7*d* having entered its locking state to lock the actuating member 7 in its operating condition, wherein the actuating member 7 has entered its second position (from its first position).

The locking means can include a hook member locking structure 10*n* for receiving and retaining the hook member 7*d* when the actuating member 7 is in its operating condition. The hook member 7*d* and locking structure 10*n* can be configured to cooperate to allow axial valve actuating movement of the actuating member 7 when the actuating member 7 is in its operating condition. For example, a locking surface of the hook member 7*d* that faces the locking structure 10*n*, can slide in axial direction along the locking structure 10*n* when the actuating member 7 is being operated. Also, for example, the guided section 7*b* of the actuating member 7 can include an axial notch section 7*n* for receiving the locking structure 10*n* of the coupling structure 10 during such operation. In an embodiment, the hook member 7*d* can be defined by the axial notch section 7*n* and a further circumferential notch section 7*m* of the coupling structure 10 (providing an L-shaped notch 7*m*, 7*n*). The hook member 7*d* can e.g., be a resilient hook member 7*d*, that can resiliently deform or deflect upwardly during circumferential passage of the locking structure 10*n* (during movement of the actuating member 7 from its first to its second position), to return to an initial undeformed or undeflected state when the locking structure 10*n* enters the axial notch section 7*n*.

When the actuating member 7 is in its second position (being locked in that position), it can e.g., be pivoted with respect to the coupling structure 10, to its third position, to press the stem 4*a* of the valve downwardly (in order to open the valve). The manually operable actuating member 7 can include a pivot section 7*p* (see FIG. 5), for example a protrusion, configured to define a pivot axis P with a pivot section 10*p* of the coupling structure 10 (see FIG. 14) for providing a pivotal valve actuating movement of the actuating member 7 when that member is in its operating condition. Said pivot sections 7*p*, 10*p* preferably engage one another when the actuating member 7 has been moved from its first to its second position. For example, the pivot section 7*p* of the actuating member 7 can be part of said guided section 7*b* and can be located in the guide space G defined by the coupling member 10.

During operation, initially, before a first use (when the container has not dispensed any product F yet), the actuating member 7 is in its first position with respect to the coupling structure 10 (see FIG. 2A). In that position, actuating movement (i.e., pivotal movement) of the actuating member 7 can be blocked by the blocking means 10*b* (e.g., an upper edge of the slot or notch section 10*b*) of the coupling structure.

In order to dispense product for the first time, any optional cap 8 can be removed, and the actuating member 7 can be turned from its first position to its second position (shown in FIG. 2B) with respect to the coupling structure 10. For example, the user can manually press the pressing member 7*a* sideways to turn it out of the first notch section 10*b* and into the second notch section 10*c* of the coupling member 10. According to an embodiment, this movement can involve overcoming a retaining force provided by a cam section 10*e* of the discharge device 3 (e.g., of an edge of the side wall 10*a* of the coupling member). Also, this movement can involve deforming or deflecting a locking hook member 7*d* of the discharge device 3 from an initially undeformed state.

Once the actuating member 7 enters its second position, it becomes locked in its operating condition. For example, this can involve snapping the hook member 7*d* in place, in a locking position (as in FIG. 3). Preferably, subsequent turning the actuating member 7 back to its first position is not possible anymore when it has been locked in its second position (at least not possible without breaking or damaging device components). For example, the hook member 7*d* returns to its initial undeformed or undeflected state, and the locking structure 10*n* enters the respective axial notch section 7*n*, once the actuating member 7 enters its second position.

Then, the actuating member 7 can be operated by a user, manually via the respective pressing member 7*a*, to discharge food product F from the container 1, the user pivoting/tilting the actuating member 7 (and respective dispensing head 5) to its third position (FIG. 2C).

It follows that the user operable pressing member (e.g., handle) 7*a* is only possible to take in use (to activate) after it has been turned to a proper second position with respect to a base part (i.e., coupling member) of the discharge device 3. In this way, the rotational position of the pressing member as such provides tamper evidence. Also, changes of auto-activation of the discharge device 3 can be reduced, whereas the aerosol container provides improved user handleability.

Figure 20:
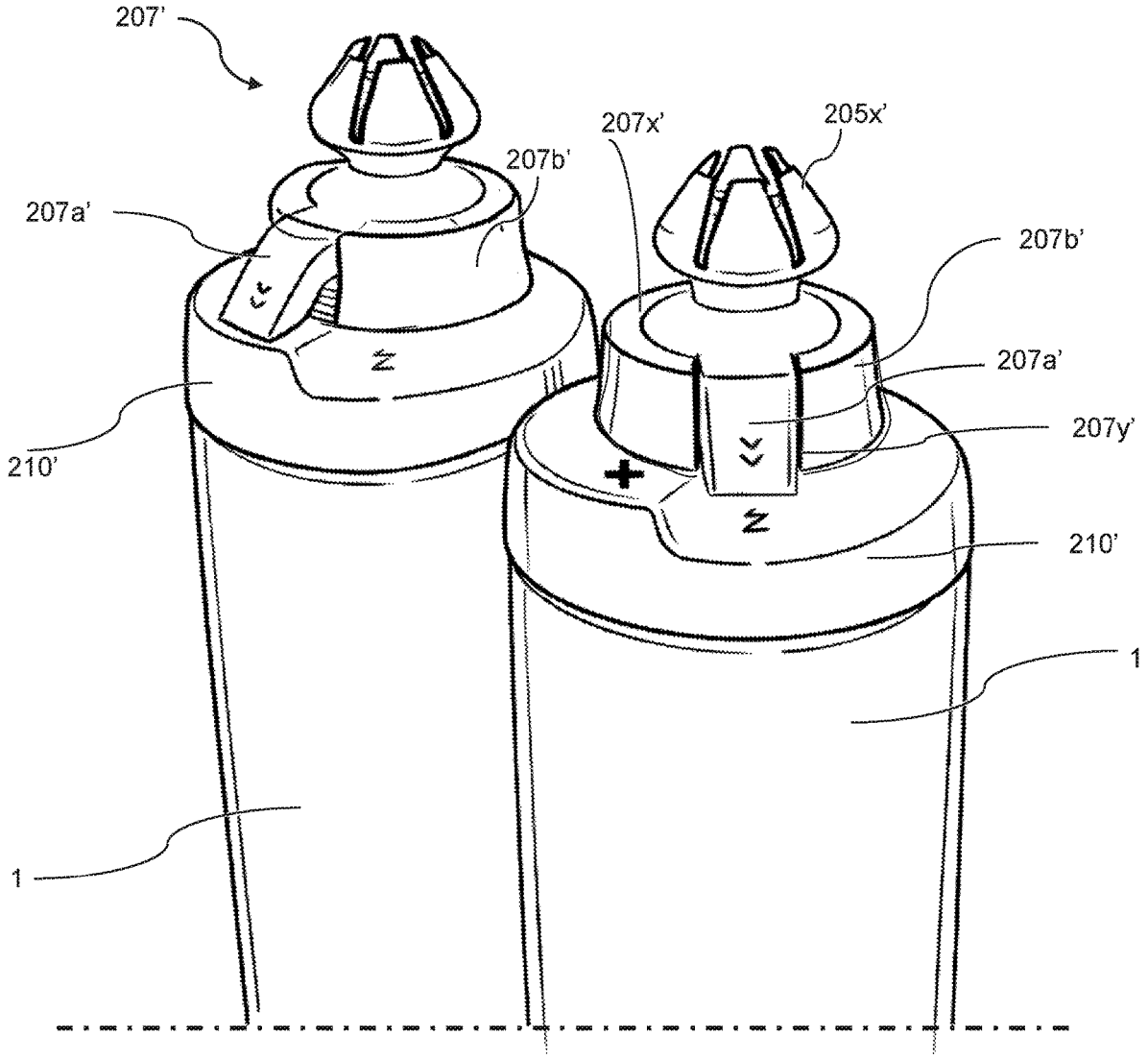
FIG. 20 shows a perspective view of two embodiments similar to the second embodiment, the embodiment depicted on the left having the actuating member in its first position and the embodiment depicted on the right with the actuating member in its second position.

FIGS. 16-19 and FIG. 20 show further examples of the present invention, which differ from the embodiment of FIGS. 2-15 in that the actuating member 207 (or actuating structure) of the discharge device 203 includes a manually operable pressing member 207*a*, for example a lever or knob, extending laterally from a guided section (carrier/support section) 207*b*, wherein the manually operable pressing member 207*a* is pivotally connected to the guided section 207*b*, in particular via a respective pivot connection 207*p* (for providing a respective pivot axis that is normal with respect to the container center axis X). The pivot connection 207*p* can e.g., be a hinge film or different type of connection. The dispensing head 205 can e.g., be integrally connected to or be part of (e.g., made in once piece with) the manually operable pressing member 207*a*. The guided section 207*b* of the actuating member can e.g. include a side wall extending concentrically with respect to a center axis of the container 1, the side wall (207*b*) having a notch 207*y* for receiving part of the pressing member 207*a*. Optionally, the guided section 207*b* of the actuating member can include a top wall 207*x* having an aperture for receiving (embedding) a proximal part 207*z* of the pressing member 207*a*, an inner rim of the aperture e.g. extending opposite an outer edge of the proximal part 207*z* of the pressing member 207*a* at a relatively small distance (e.g. about 1 mm or less). FIG. 20 shows a similar embodiment, having a slightly differently shaped actuating member 207', with guided section 207*b*', top wall 207*x*', notch 207*y*' and respective pressing member 207*a*', as well as respective coupling member 210' and dispensing head 205'.

Besides, the guided section 207*b* of the actuating member can be rotatably held by (i.e. guided by) the respective coupling structure 210 of the discharge device 203, such that the respective actuating member 207 can be rotated with respect to the coupling structure 210 from the first position to the second position about its rotation axis X, in particular the axis of rotation X that extends in parallel with a center line of the container 1 and/or in parallel with a valve stem of the discharge valve 4 of the container 1.

The coupling structure 210 can define a guide space G', the guided section 207*b* being (rotatably) held in the guide space G'.

The guided section 207*b* of the actuating member can be rotatably coupled to the coupling structure 210 in various ways, e.g. via a number of snap fingers 207*v* (e.g. three as in this embodiment, or more than three), protruding radially outwardly from the guided section 207*b*, and snapping behind/below respective snap finger receiving section 210*w* (e.g. cam or rim section) of the of the coupling structure 210 after mounting (thereby axially locking the guided section 207*b* to the coupling structure 210). Said respective snap finger receiving section 210*w* of the coupling structure 210 can e.g., extend around/along the guide space G', in particular in a circumferential direction (i.e., concentrically around an axis of rotation of the guided section 207*b*).

The discharge device 203 can also include blocking means 210*b* for preventing valve actuating movement of the actuating member 207 when the actuating member 207 is in its first position (shown in FIGS. 17, 18, 19), the blocking means being e.g., configured similar as above (concerning the first example). The blocking means 210*b* can e.g. include a wall, rim or cam structure, reaching towards an opposite bottom of the pressing member 207*b*, for example towards a said proximal section 207*z* of that pressing member 207*b*, for the blocking downward movement of the pressing member 207*b* (when the actuating member 207 is in its first position), and the blocking means 210*b* can be configured to allow the downward movement of the pressing member 207*b* when the respective actuating member 207 has been rotated to its second position.

Moreover, the discharge device 207 can includes locking means 207*d*, 210*n* for locking the actuating member 207 in its operating condition, the locking means 207*d* in particular preventing moving the actuating member (i.e., both its guided member 207*b* and pressing member 207*a*) back from the second position to the first position. The locking means can include a hook member 207*d* being e.g., part of the guided member 207*b* of the actuating member, configured to enter a locking state to lock the guided member 207*b* of the actuating member in its operating condition when the guided member has been rotated to a respective second position from its first position (as with the container 1 shown on the right in FIG. 20). Optionally, the locking means (e.g., hook member 207*b*) can be provided by one or more of the above-mentioned snap fingers 207*v* (see FIGS. 19A, 19B, 19C). Alternatively, one or more dedicated locking means can be provided that are separate of such snap fingers 207*v*.

The locking means can additionally include a locking structure 210*n*, being part of the coupling structure 210, for receiving and retaining the or each hook member 207*d* (which e.g., can be an afore-mentioned snap finger 207*v*) when the guided section 207*b* of the actuating member 207 has been moved into its operating condition. The hook member locking structure 210*n* can e.g. include a resilient protrusion, retaining hook, barb (see FIG. 19C) or the-like, that can e.g. resiliently deform or deflect radially (e.g. inwardly or outwardly) during circumferential passage of a hook member 207*d* to be locked (the passage resulting from rotation of the guided section 207*b* of the actuating member 207 from its first—idle—position to its second position), to return to the depicted initial undeformed or undeflected or less deformed state once the or each hook member 207*d* has been received in/by that hook member locking structure 210*n*. Arrow DEF in FIG. 19C indicates a direction of resilient deflection of said a hook member locking structure 210*n*, and arrow PAS indicates a direction of circumferential passage of a corresponding hook member 207*d* (to be locked). It is preferred that after the of each hook member 207*d* has been received by the respective locking structure 210*n*, rotation of the guided section 207*b* of the actuating member with respect to the coupling structure is not possible anymore (i.e., the guided section 207*b* is rotationally locked). In other words, it is preferred that the locking means 207*d*, 210*n* of the discharge device 203 can apply a mechanical locking force to the guided section 207*b* of the actuating member 207 to lock that section in its second position, wherein the locking force cannot be overcome without damaging (e.g., plastically deforming or breaking) components of the discharge device 203.

Besides, in the latter, rotationally locked position of the guided section 207*b*, the pressing member 207*b* has been moved away from the blocking means 210*b* so that the pressing member can be actuated (i.e., pivoted with respect to the guided section 207*b*, to move to a respective third position) for dispensing product.

FIG. 20 shows on the left the container 1, with the respective guided section 207*b*' being in an initial position, providing the first position of its actuating member 207'. In that position, the respective blocking means 210*b* prevent valve actuating movement of the actuating member 207'.

FIG. 20 shows on the right the container 1, with the respective guided section 207*b*' being rotated with respect to the coupling member 210' to its second position, providing the second position of its actuating member 207'. In that position, the respective blocking means 210*b* do not prevent valve actuating movement of the actuating member 207', i.e., the pressing member 207*a*' can be manually pivoted downwardly/inwardly with respect to the guided section 207*b*' (to a respective third position) to operate (open) the valve of the container 1. Besides, after the respective guided section 207*b*' has being rotated with respect to the coupling member 210' to its second position, that guided section 207*b*' can not be rotated back to its first position (due to the locking action of the respective locking means). It follows that in these embodiments, part of the actuating member (e.g., the guided section 207*b*') can remain in its locked second position when the other part (the manually operable pressing member 207*a*') is moved to its third position.

Also, in the above embodiments, returning the pressing member 7, 207, 207' to its idle operating position (i.e., from its third position to its second position, after a user has stopped applying manual operating action onto the pressing member) can be achieved via spring means of the container valve 4, the spring means counteracting the depressing of the stem 4*a* (and urging the valve to its closed position) as will be clear to the skilled person.

While the invention has been explained using exemplary embodiments and drawings, these do not limit the scope of the invention in any way, said scope being provided by the claims. It will be appreciated that many variations, alternatives and extensions are possible within said scope, as will be clear to the skilled person from the description and the drawings. For example, the term actuating member as such can be construed broadly, since it can concern a single component (e.g., being made in one-piece) or a structure of several interconnected components, as will be clear to the skilled person.

For example, the skilled person will appreciate that the locking means for locking the actuating member in its operating condition can be configured in various ways, and can include e.g. one or more cooperating cam structures and/or cooperating notches (e.g. provided by one or more hook members and respective one or more hook member locking structures, that can be part of the coupling structure and of the actuating member), wherein such one or more cam structures and/or notches can lock together once the actuating member has been brought into its operation condition.

The invention claimed is:

1. An aerosol container provided with a manually operable discharge device comprising a coupling structure for connecting the discharge device to the aerosol container, wherein the discharge device comprises a manually operable actuating member that is positioned in a first position with respect to the coupling structure before initial use, wherein the discharge device comprises blocking for preventing valve actuating movement of the actuating member when the actuating member is in its first position, wherein the actuating member is movable from the first position to a second position with respect to the coupling structure, the second position providing an operating condition of the actuating member for actuating a discharge valve of the container to discharge food product, wherein at least part of the actuating member is manually movable with respect to the container for actuating a valve stem of the valve when the actuating member is in its operating condition, wherein the discharge device comprises a lock for locking the actuating member in its operating condition, the lock preventing moving the actuating member back from the second position to the first position, and wherein the lock of the discharge device is configured to apply a mechanical locking force to the actuating member to lock the actuating member in its operating condition, wherein the locking force cannot be overcome without damaging components of the discharge device.

2. The aerosol container according to claim 1, wherein the lock comprises a hook member configured to enter a locking state to lock the actuating member in its operating condition when the actuating member enters its second position from its first position.

3. The aerosol container according to claim 2, wherein the lock comprises a hook member locking structure for receiving and retaining the hook member when the actuating member is in its operating condition, wherein the hook member and locking structure are optionally configured to allow valve actuating movement of the actuating member when the actuating member is in its operating condition.

4. The aerosol container according to claim 1, wherein the discharge device comprises a retainer for releasably retaining the actuating member in its first position.

5. The aerosol container according to claim 1, wherein the actuating member is rotatably held by the coupling structure such that the actuating member can be rotated from the first position to the second position about a rotation axis.

6. The aerosol container according to claim 5, wherein the axis extends in parallel with a center line of the container and/or in parallel with a valve stem of the discharge valve of the container.

7. The aerosol container according to claim 1, wherein the coupling structure defines a guide space, the actuating member having a guided section that is held in the guide space, the actuating member further comprising a manually operable pressing member extending laterally from the guided section out of the coupling structure.

8. The aerosol container according to claim 7, wherein the pressing member comprises a lever or knob.

9. The aerosol container according to claim 7, wherein the coupling structure and guided section of the actuating member are configured to cooperate to limit movement of the actuating member.

10. The aerosol container according to claim 7, wherein the coupling structure comprises a side wall having a first notch section for receiving part of the pressing member when the actuating member is in its first position, and a second notch section for receiving part of the pressing member when the actuating member is in its second position and a third position, wherein the side wall (10*a*) of the coupling structure extends concentrically with respect to a center axis of the container.

11. The aerosol container according to claim 10, wherein a circumferential width of the first notch section is about the same as or slightly larger than a circumferential width of the pressing member, and/or wherein a circumferential width of the second notch section is slightly larger than a circumferential width of the pressing member.

12. The aerosol container according to claim 7, wherein the guided section of the actuating member has a number of snap fingers, optionally protruding radially outwardly from the guided section, axially locking the guided section to the coupling structure.

13. The aerosol container according to claim 12, wherein the locking is via a respective snap finger receiving section of the of the coupling structure.

14. The aerosol container according to claim 7, wherein the manually operable pressing member is pivotally connected to the respective guided section, optionally via a respective pivot connection.

15. The aerosol container according to claim 1, wherein the manually operable actuating member comprises a pivot section, configured to define a pivot axis with a pivot section of the coupling structure for providing a pivotal valve actuating movement of the actuating member when that member is in its operating condition, wherein the pivot sections optionally engage one another when the actuating member is moved from its first to its second position.

16. The aerosol container according to claim 15, wherein the pivot section of the actuating member is part of the guided section and is located in the guide space defined by the coupling member.

17. The aerosol container according to claim 1, wherein the actuating member integrally comprises a dispensing head for dispensing food product, wherein the actuating member the dispensing head optionally extends axially opposite a valve stem of the container valve to receive food product therefrom.

18. The aerosol container according to claim 1, wherein the lock of the discharge device is configured to ensure that the actuating member remains in its second position so that it can be manually operated by a user, the locking means preventing return of the actuating member to the first position.

19. A method of dispensing a food product, comprising:

(a) providing the aerosol container according to claim 1 having the actuating member is in its first position with respect to the coupling structure;

(b) moving the actuating member from the first position to the second position with respect to the coupling structure, such that the actuating member becomes locked in its operating condition; and (c) manually actuating the actuating member to discharge food product from the container.

* * * * *